US006454046B1

(12) United States Patent
Chuang

(10) Patent No.: US 6,454,046 B1
(45) Date of Patent: Sep. 24, 2002

(54) SYNCHRONOUS DUSTPROOF COVER STRUCTURE FOR SOUND MEMBRANE

(76) Inventor: Po-An Chuang, 12F-2, No. 376, Tun-Hwa South Rd. Sec. 1, Taipei (TW)

( * ) Notice: Subject to any disclaimer, the term of this patent is extended or adjusted under 35 U.S.C. 154(b) by 49 days.

(21) Appl. No.: 09/697,049

(22) Filed: Oct. 27, 2000

(51) Int. Cl.[7] ..... G10K 13/00
(52) U.S. Cl. ..... 181/167; 181/163; 181/164
(58) Field of Search ..... 181/163, 164, 181/165, 166, 173, 174, 167, 157, 169

(56) References Cited

U.S. PATENT DOCUMENTS

| | | | | |
|---|---|---|---|---|
| 4,225,757 A | * | 9/1980 | Babb | 179/115.5 R |
| 6,242,281 B1 | | 6/2001 | Mclellan et al. | 438/106 |
| 6,294,100 B1 | | 9/2001 | Fan et al. | 216/14 |

* cited by examiner

*Primary Examiner*—Robert E. Nappi
*Assistant Examiner*—Kim Lockett
(74) *Attorney, Agent, or Firm*—Dennison, Schultz & Dougherty

(57) ABSTRACT

Synchronous dustproof cover structure for sound membrane. The dustproof cover structure being made of a light and rigid material. Multiple reinforcing ribs are perpendicularly disposed on one face of the dustproof cover at equal intervals. Bottom ends of the multiple reinforcing ribs are connected with adjoining sections of the sound basin and the sound ring. The circumference of the dustproof body is connected on the sound basin, whereby the dustproof cover, the sound basin and the sound ring are connected into an integral body and the sound basin and the dustproof cover are synchronously vibrated with the sound ring to emit sound. The multiple reinforcing ribs are connected with the sound basin and the sound ring at multiple points so as to enhance the rigidity and strength of the sound basin. Therefore, the distortion of the sound basin at high volume can be reduced and a good quality of sound can be achieved.

2 Claims, 4 Drawing Sheets

SYNCHRONOUS DUSTPROOF COVER STRUCTURE FOR SOUND MEMBRANE

BACKGROUND OF THE INVENTION

The present invention relates to a synchronous dustproof cover structure for sound membrane. The dustproof cover structure is connected with the sound basin and the sound ring at multiple points to form an integral body so that the dustproof cover and the sound basin are synchronously vibrated with the sound ring to emit sound. In addition, the dustproof cover is connected with the sound basin and the sound ring at multiple points so that the rigidity and strength of the sound basin are enhanced and the distortion of the sound basin at high volume is reduced. The dustproof cover structure is applicable to a speaker.

FIG. 1 shows a conventional speaker structure composed of a speaker housing A, a magnet B, a sound ring C, a resilient waved plate D, a sound basin E, a dustproof cover F, a T-iron G, a washer H and a suspending circumference I. The sound ring C is fitted around the central boss of the T-iron G. A coil C1 is wound on the sound ring C. The resilient waved plate D and the sound basin E are fitted on the sound ring C at the central holes. The dustproof cover F is fixed at the top end of the sound ring C. The sound ring C and the sound basin E via the resilient waved plate D and the suspending circumference I are suspended between the other components to form a speaker structure.

One end of the sound ring C is connected with the sound basin E, resilient waved plate D and the dustproof cover F and suspended around the central boss of the T-iron. After powered on, the coil C1 of the sound ring C is attracted and vibrated to make the sound ring C start to move up and down. The sound basin E and the dustproof cover F connected with the sound ring C further transmit the vibration to the air to form sonic wave conceivable by ears.

The conventional dustproof cover is convex or concave and only the rim of the dustproof cover F is connected with the sound basin E. Therefore, the dustproof cover F cannot be synchronously vibrated with the sound basin E. Moreover, the convex or concave surface of the dustproof cover has ununified reflectivity when vibrated so that the sound emitted thereby is unpleasant noise.

In order to solve this problem, a phaser has been developed as shown in FIG. 2. The phaser K is directly connected on the central boss of the T-iron G. The sound basin E is positioned around the phaser K. In the speaker, the middle or high tune sound is produced at the inner rim of the sound basin E. Therefore, the sonic wave of the middle or high tune sound will be half reflected by the phaser K in the beginning. As a result, a user will hear a sound with inaccurate sonic field.

SUMMARY OF THE INVENTION

It is therefore a primary object of the present invention to provide to a synchronous dustproof cover structure for sound membrane. The dustproof cover structure has over one connecting point so that the dustproof cover, the sound ring and the sound basin are integrally connected. Therefore, the sound basin and the dustproof cover are synchronously vibrated with the sound ring.

It is a further object of the present invention to provide the above synchronous dustproof cover structure which is connected with the sound ring and sound basin at multiple points so as to enhance the rigidity and strength of the sound basin. Therefore, the distortion of the sound basin at high volume can be reduced.

It is still a further object of the present invention to provide the above synchronous dustproof cover structure which has a plane surface so that when vibrated at middle or high tune, the sound is parallelly outward spread in a unified state. Therefore, a good quality of sound can be achieved.

According to the above objects, the synchronous dustproof cover structure for sound membrane of the present invention is made of a light and rigid material. Multiple reinforcing ribs are perpendicularly disposed on one face of the dustproof cover at equal intervals. Bottom ends of the multiple reinforcing ribs are connected with adjoining sections of the sound basin and the sound ring. The circumference of the dustproof body is connected on the sound basin, whereby the dustproof cover, the sound basin and the sound ring are connected into an integral body and the sound basin and the dustproof cover are synchronously vibrated with the sound ring to emit sound. The multiple reinforcing ribs are connected with the sound basin and the sound ring at multiple points so as to enhance the rigidity and strength of the sound basin. Therefore, the distortion of the sound basin at high volume can be reduced and a good quality of sound can be achieved.

The present invention can be best understood through the following description and accompanying drawings wherein:

DETAILED DESCRIPTION OF THE PREFERRED EMBODIMENT

Figure 1:
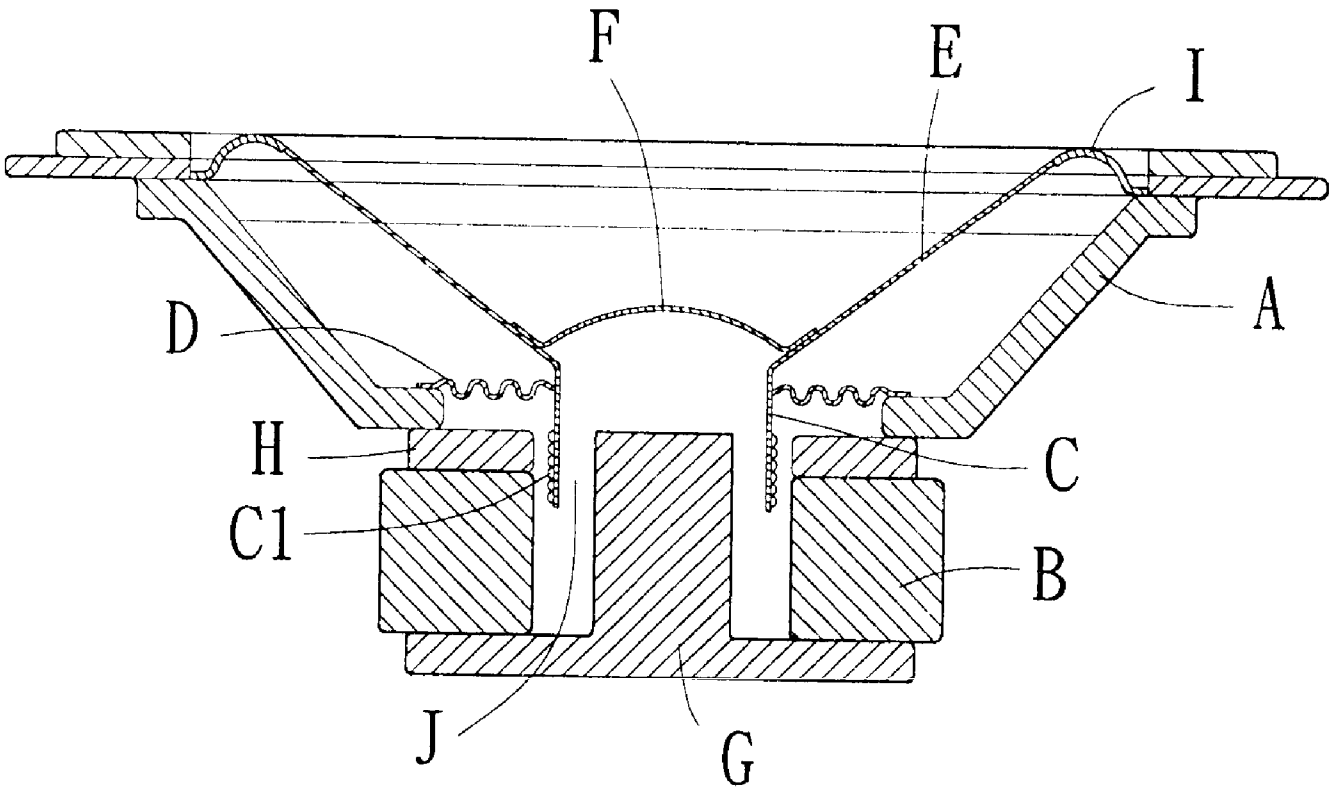
FIG. 1 is a sectional assembled view of a conventional speaker.
Figure 2:
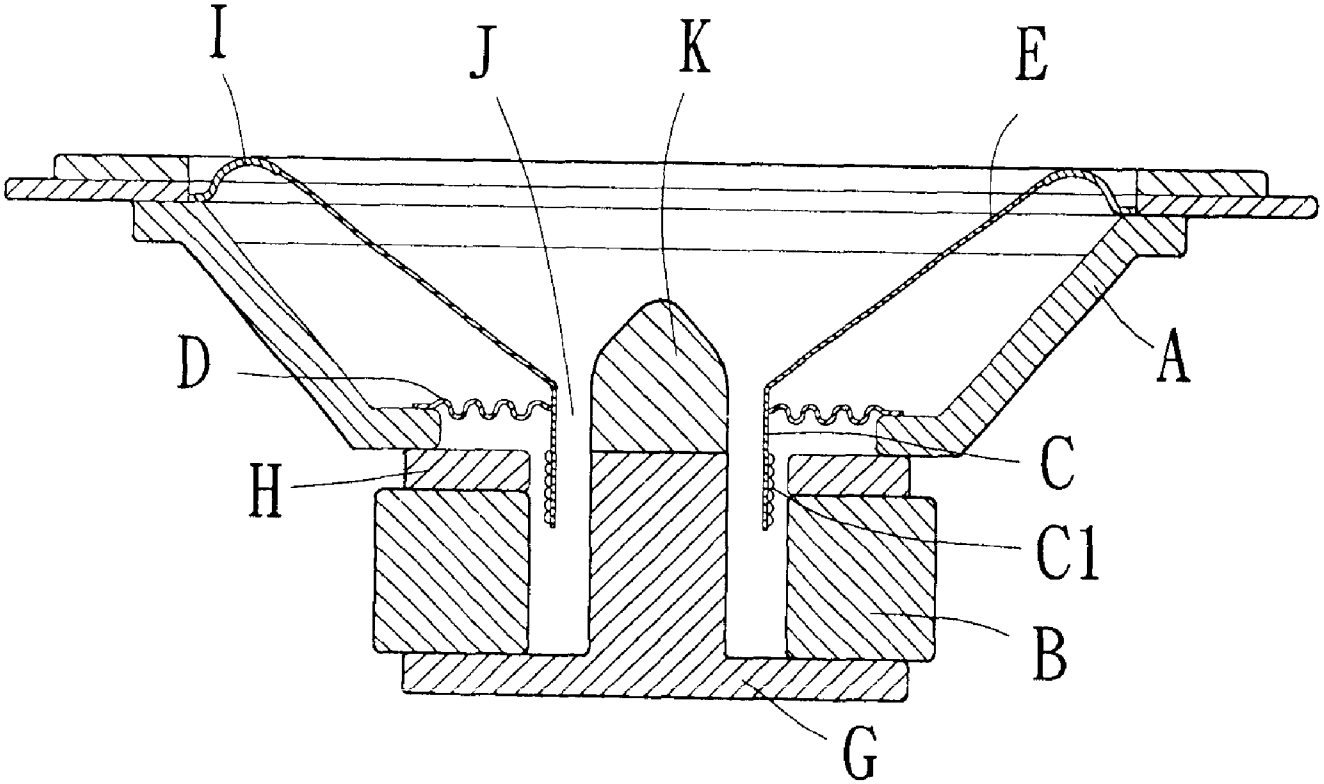
FIG. 2 is a sectional assembled view of another type of conventional speaker.
Figure 3:
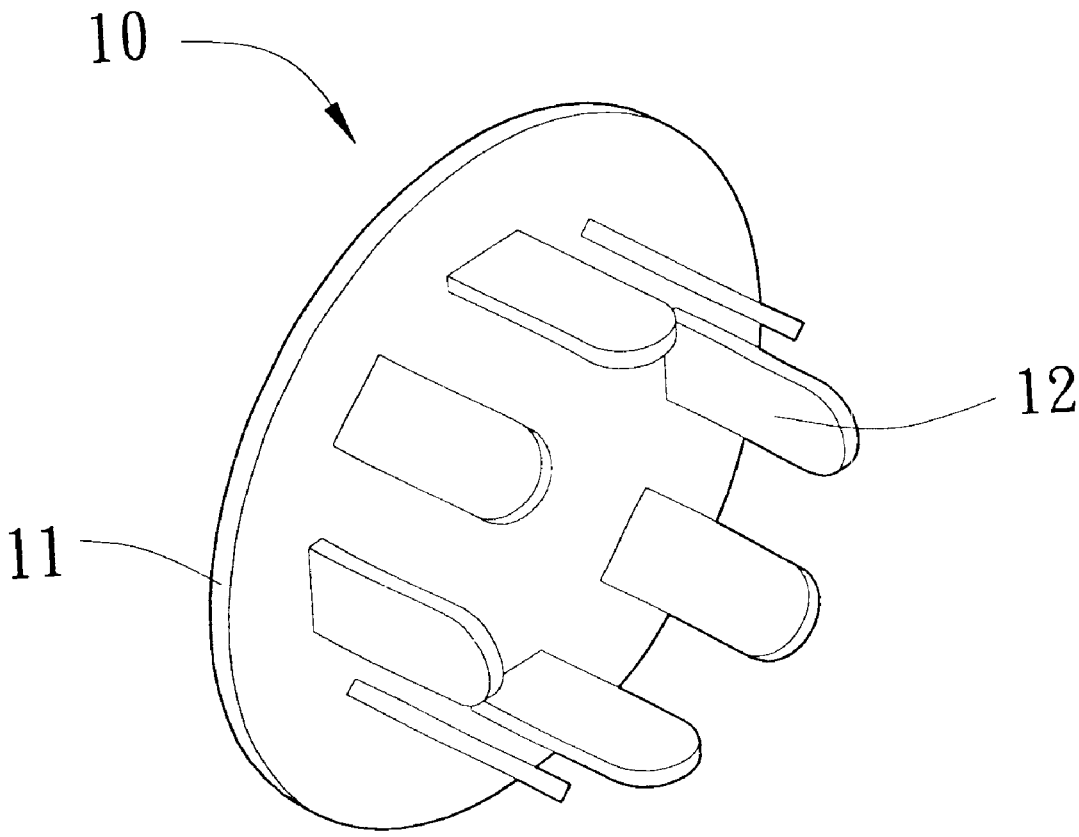
FIG. 3 is a perspective view of the dustproof cover structure of the present invention.

Please refer to FIG. 3. The dustproof cover 10 of the present invention is a circular plate body made of light and rigid materal and having a certain dimension. The circular plate body has a plane face 11. Multiple reinforcing ribs 12 are perpendicularly disposed on the bottom side of the plane face 11 about the circular center thereof at equal intervals. The reinforcing rib 12 is substantially a rectangular plate body.

Figure 4:
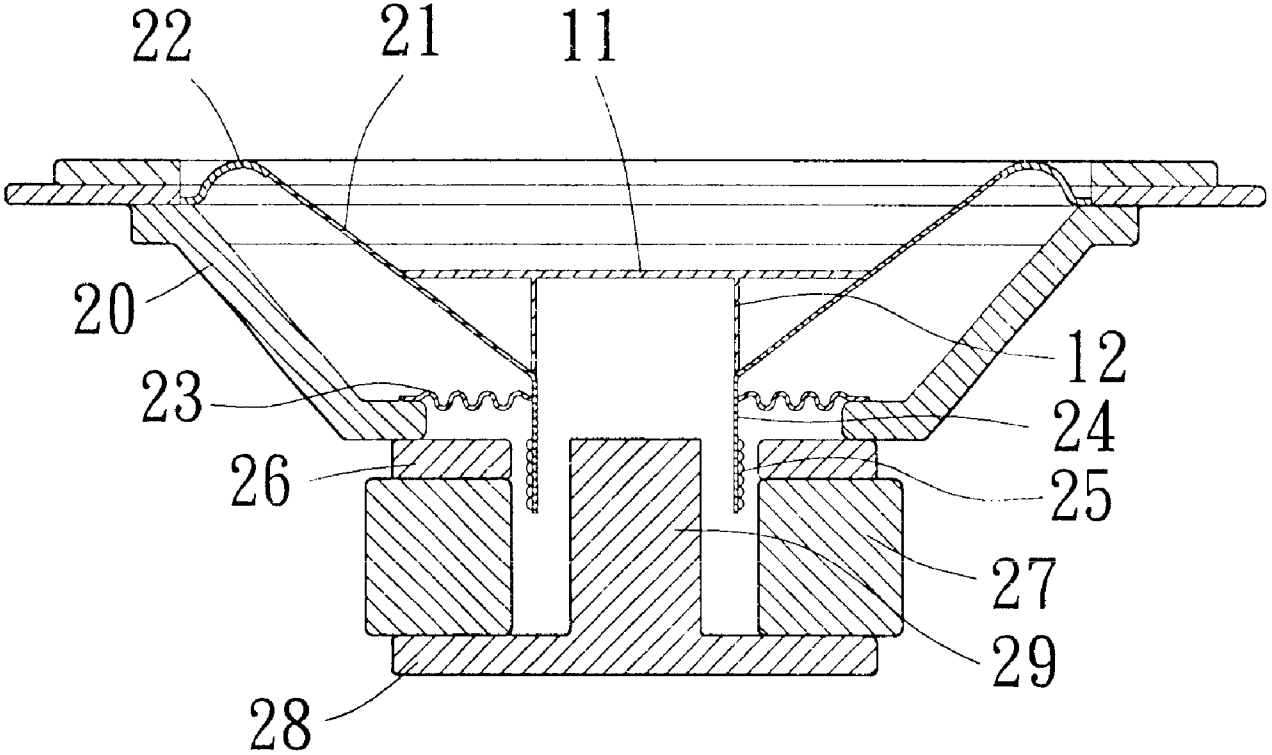
FIG. 4 is a sectional assembled view showing that the dustproof cover structure is connected with a speaker.

FIG. 4 is a sectional view showing that the dustproof cover 10 is connected with a speaker. An annular magnet 27 is disposed above the T-iron 28 with the central boss 29 of the T-iron 28 positioned at the center of the magnet 27. An iron washer 26 is positioned above the magnet 27. Then an outward diverging conic speaker housing 20 is connected to outer side of the washer 26. The suspending circumference 22 of top edge of the speaker housing 20 connected with the sound basin 21. The bottom edge of the sound basin 21 is connected with a resilient waved plate 23 and a sound ring 24. The sound ring 24 is made of a film by winding. A coil 25 is wound on the bottom of the sound ring 24. The sound ring 24 is positioned in the space between the washer 26 and the boss 29 of the T-iron 28. Finally, the dustproof cover 10 of the present invention is placed at the center of the sound basin 21 with the reinforcing ribs 12 directed downward. The bottom ends of the multiple reinforcing ribs 12 are connected with the adjoining sections of the sound ring 24 and the sound basin 21. The circumference of the plane face 11 of the dustproof cover 10 is connected on the sound basin

21. Therefore, the dustproof cover 10 is no longer connected with the sound basin 21 at single point. Instead, the dustproof cover 10, sound basin 21 and sound ring 24 are integrally connected to complete the assembly.

After the speaker is powered on, the magnet 27 is energized to create a magnetic field for attracting the coil 25. At this time, the sound ring 24 starts to vibrate. The dustproof cover 10 is fixedly connected with the sound basin 21 and the sound ring 24 at over two points so that the sound basin 21 and the dustproof cover 10 are synchronously vibrated with the sound ring 24. Furthermore, the dustproof cover 10 has a plane surface 11 so that when vibrated, the sound is parallelly outward spread in a unified state. Therefore, the reflection existing in the conventional convex or concave dustproof cover or phaser is eliminated.

According to the above arrangement, the present invention has the following advantages:

1. The dustproof cover structure of the present invention can achieve a dustproof effect. In addition, multiple reinforcing ribs project from bottom face of the dustproof cover to integrally connect with the sound ring and sound basin at multiple points. Therefore, the sound basin and the dustproof cover are synchronously vibrated with the sound ring.

2. The reinforcing ribs perpendicularly project from the bottom of the dustproof cover to enhance the rigidity and strength of the sound basin. Therefore, the distortion of the sound basin at high volume can be reduced.

3. The dustproof cover has a plane surface so that when vibrated at middle or high tune, the sound is parallelly outward spread in a unified state. Therefore, no reflection will take place and a good quality of sound can be achieved.

The above embodiment is only used to illustrate the present invention, not intended to limit the scope thereof. Many modifications of the above embodiment can be made without departing from the spirit of the present invention.

What is claimed is:

1. A synchronous dustproof cover structure for sound membrane, said dustproof cover structure comprising a flat circular body having outer and inner surfaces, a center portion and a plurality of reinforcing ribs fixed to and extending in an inward direction from said inner surface of said flat circular body at equal intervals about said center portion and said reinforcing ribs having a generally rectangular shape and bottom ends adapted to be connected to adjoining sections of a sound basin and a sound ring, and said flat circular body adapted to be connected to the sound basin whereby the sound basin and soundproof cover are connected together at multiple points to enhance the rigidity and strength of said sound basin and the distortion of the sound basin at high volume is reduced.

2. A synchronous dustproof cover structure according to claim 1 which includes eight reinforcing ribs.

* * * * *